United States Patent [19]

Lehmann et al.

[11] 3,936,317

[45] Feb. 3, 1976

[54] DISHWASHING COMPOSITIONS CONTAINING HIGHER 1,2-ALKANEDIOL ETHER MONOSULFATES

[75] Inventors: Hans-Jürgen Lehmann, Mettmann; Martin Bischoff, Gelsenkirchen; Horst Baumann, Leichlingen; Peter Krings, Krefeld, all of Germany

[73] Assignee: Henkel & Cie G.m.b.H., Dusseldorf-Holthausen, Germany

[22] Filed: Feb. 21, 1975

[21] Appl. No.: 551,710

Related U.S. Application Data

[63] Continuation-in-part of Ser. No. 362,324, May 21, 1973, abandoned.

[30] Foreign Application Priority Data

June 2, 1972 Germany ..... 2226988
Feb. 27, 1973 Germany ..... 2309679

[52] U.S. Cl. ..... 134/29; 252/153; 252/173; 252/541; 252/545; 252/550; 252/551; 252/552; 252/553; 252/DIG. 14; 260/458

[51] Int. Cl.[2]... C11D 1/16; C11D 1/29; C11D 1/37; C11D 17/08

[58] Field of Search ..... 252/531, 532, 533, 534, 252/541, 545, 550, 551, 552, 553, 153, 173, 121, DIG. 14; 260/458, 459; 134/29

[56] References Cited

UNITED STATES PATENTS

| | | | |
|---|---|---|---|
| 3,380,925 | 4/1968 | Blaser | 252/551 |
| 3,607,778 | 9/1971 | Lincoln | 252/353 |
| 3,639,291 | 2/1972 | Casey | 252/551 X |
| 3,686,098 | 8/1972 | Weil | 252/550 |
| 3,758,410 | 9/1973 | Liu | 252/89 |

FOREIGN PATENTS OR APPLICATIONS

| | | | |
|---|---|---|---|
| 1,910,765 | 10/1969 | Germany | 252/551 |
| 7,306,270 | 12/1973 | Netherlands | 252/551 |

*Primary Examiner*—Dennis L. Albrecht
*Attorney, Agent, or Firm*—Hammond & Littell

[57] ABSTRACT

A dishwashing and cleansing agent composition for manual dishwashing based upon anionic surface-active surfactants consists essentially of (A) from 20% to 90% by weight of a higher sulfonate or sulfate of the group of the alkyl sulfonates, olefin sulfonates, α-sulfofatty acid alkyl esters, dialkyl sulfosuccinic esters, alkylbenzene sulfonates and alkyl sulfates, each having 8 to 20 carbon atoms in the hydrophobic moiety, and (B) from 10% to 80% by weight of a mono- or polyglycol ether sulfate of a higher 1,2-alkanediol having 10 to 22 carbon atoms; as well as a dishwashing concentrate containing this composition and a method of using this composition.

9 Claims, No Drawings

DISHWASHING COMPOSITIONS CONTAINING HIGHER 1,2-ALKANEDIOL ETHER MONOSULFATES

REFERENCE TO A PRIOR APPLICATION

This application is a continuation-in-part of our copending U.S. patent application Ser. No. 362,324, filed May 21, 1973, now abandoned.

PRIOR ART

Mainly high-sudsing anionic surface-active surfactants are used for manual dishwashing particularly alkyl sulfonates, alkyl benzene sulfonates, fatty alcohol sulfates and fatty alcohol polyglycol ether sulfates, with mixtures of these surfactants being mostly used in practice. Since these combinations are used frequently as aqueous liquid concentrates or as aqueous alcoholic concentrates, the packing and shipping costs become an important consideration because of the relatively high content of inactive solvents.

OBJECTS OF THE INVENTION

It is an object of the present invention to increase the cleansing power of cleansing concentrates while lowering the necessary amounts to be used by the additional use of monoglycol ether sulfates or polyglycol ether sulfates of higher 1,2-alkanediols.

It is another object of the present invention to provide an anionic surface-active composition for manually washing and cleansing dishes consisting essentially of (A) from 20% to 90% by weight of a first component selected from the group consisting of alkyl sulfonates having 8 to 20 carbon atoms, olefin sulfonates having 8 to 20 carbon atoms, α-sulfo-fatty acid alkyl esters having 8 to 20 carbon atoms in the α-sulfofatty acid and 1 to 4 carbon atoms in the alkyl, dialkyl sulfosuccinic acid esters having 8 to 20 carbon atoms in the alkyls, alkylbenzene sulfonates having 8 to 20 carbon atoms in the alkyl, alkyl sulfates having 8 to 20 carbon atoms and the mixtures thereof and (B) from 10% to 80% by weight of a second component selected from the group consisting of a monoglycol ether sulfate of a 1,2-alkanediol having 10 to 22 carbon atoms and a polyglycol ether sulfate of a 1,2 -alkanediol having 10 to 22 carbon atoms, said components (A) and (B) being present in the form of their salts selected from the group consisting of alkali metal salts, ammonium salts, lower alkanol amine salts, lower alkylamine salts and the mixtures thereof.

It is a further object of the present invention to provide a dishwashing and cleansing agent concentrate for manual dishwashing based upon anionic surface active surfactants consisting essentially of (I) from 10% to 60% by weight of the above washing composition, (II) from 0% to 10% by weight of other customary dishwashing concentrate ingredients, and (III) the remainder to 100% by weight of an aqueous liquid.

It is still another object of the present invention to provide a development in the process for the manual washing of dishes which comprises subjecting dirty dishes to the action of a washing solution, subjecting the washed dishes to at least one rinsing solution and recovering said washed dishes, the improvement consisting of utilizing an aqueous solution containing from 0.01 to 10 gm/liter of the above anionic surface active composition, as said washing solution.

These and further objects of the present invention will become apparent as the description thereof proceeds.

DESCRIPTION OF THE INVENTION

The present invention concerns dishwashing and cleansing agents for the manual washing of dishes based upon anionic surface active surfactants which give synergistic cleansing results.

The present invention therefore provides an anionic surface active composition for manually washing and cleansing dishes consisting essentially of (A) from 20% to 90% by weight of a first component selected from the group consisting of alkyl sulfonates having 8 to 20 carbon atoms, olefin sulfonates having 8 to 20 carbon atoms, α-sulfofatty acid alkyl esters having 8 to 20 carbon atoms in the α-sulfofatty acid and 1 to 4 carbon atoms in the alkyl, dialkyl sulfosuccinic acid esters having 8 to 20 carbon atoms in the alkyls, alkyl-benzene sulfonates having 8 to 20 carbon atoms in the alkyl, alkyl sulfates having 8 to 20 carbon atoms and the mixtures thereof and (B) from 10% to 80% by weight of a second component selected from the group consisting of a monoglycol ether sulfate of a 1,2-alkanediol having 10 to 22 carbon atoms and a polyglycol ether sulfate of a 1,2-alkanediol having 10 to 22 carbon atoms, said components (A) and (B) being present in the form of their salts selected from the group consisting of alkali metal salts, ammonium salts, lower alkanol amine salts, lower alkylamine salts and the mixtures thereof.

The present invention also provides a dishwashing and cleansing agent concentrate for manual dishwashing based upon anionic surface active surfactants consisting essentially of (I) from 10% to 60% by weight of the above washing composition, (II) from 0% to 10% by weight of other customary dishwashing concentrate ingredients, and (III) the remainder to 100% by weight of an aqueous liquid selected from the group consisting of water and an aqueous solution of water-miscible lower alkanol.

The present invention further provides a development in the process for the manual washing of dishes which comprises subjecting dirty dishes to the action of a washing solution, subjecting the washed dishes to at least one rinsing solution and recovering said washed dishes, the improvement consisting of utilizing an aqueous solution containing from 0.01 to 10 gm/liter of the above anionic surface active composition as said washing solution.

Suitable examples of sulfonates and sulfates of component (A) include the alkanesulfonates of 8 to 20 carbon atoms, olefin sulfonates of 8 to 20 carbon atoms, α-sulfofatty acid esters of alkyls having 8 to 20 carbon atoms in the fatty acid moiety and 1 to 4 carbon atoms in the alkyl, dialkyl sulfosuccinic acid esters of 8 to 20 carbon atoms in the alkyls, saturated and unsaturated fatty alcohol sulfates of 12 to 18 carbon atoms and mixtures thereof, as they are obtained from naturally occurring fatty substances, as well as alkyl benzene sulfonates of 10 to 14 carbon atoms in the alkyl, for example, dodecyl benzene sulfonate. According to the invention, olefin sulfonates of 10 to 20 carbon atoms and alkyl benzene sulfonates of 10 to 14 carbon atoms in the alkyl are preferred. The sulfonates are present preferably as alkali metal salts such as sodium or potassium salts, ammonium salts, or amine salts, for example, lower alkylamine salts and lower alkanol amine salts such as triethanolamine salts; and can be used individually or as mixtures of salts.

Examples of component (B) are preferably straight-chained compounds of the following formula:

(I) $C_mH_{(2m+1)}-\underset{X}{CH}-\underset{Y}{CH_2}$ wherein at least one of the groups X and Y is $-(OCH_2-CHR)_n-Z$ and the other group is Z where Z is $-OH$ or $-OSO_3Me$, m is an integer from 8 to 20, n is a number from 1 to 2, R is hydrogen or methyl, Me is sodium, potassium, or ammonium or the cation of an organic ammonium base such as lower alkylammonium or lower alkylolammonium for example mono-, di- or triethanolammonium or the morpholinium cation, with the proviso that at least 50% of the compounds must have at least one $-OSO_3Me$ group. The surfactants of component (B) according to the invention are therefore comprised of a mixture in which the monosulfated compounds of the following formulae II to Va represent the majority, that is, more than 50 mol percent as follows:

(II) $C_mH_{(2m+1)}-CHOH-CH_2-(OCH_2-CHR)_n-OSO_3Me$ (III) $C_mH_{(2m+1)}-CH(OCH_2-CHR)_n-OH)-CH_2OSO_3Me$ (IV) $C_mH_{(2m+1)}-CH(OSO_3Me)-CH_2-(OCH_2-CHR)_n-OH$ (IV a) $C_mH_{(2m+1)}-CH(OCH_2-CHR)_n-OSO_3Me)-CH_2-OH$ (V) $C_mH_{(2m+1)}-CH(OCH_2-CHR)_n-OSO_3Me)-CH_2-(OCH_2-CHR)_n-OH$ (V a) $C_mH(2m+1)-CH(OCH_2-CHR)_n-OH)-CH_2-(OCH_2-CHR)_n-OSO_3Me$

Unreacted 1,2-alkanediols and compounds which contain either no sulfate groups or no glycol-ether groups, as well as disulfates of the following formulae VI to XIV can also be present:

(VI) $C_mH_{(2m+1)}-CHOH-CH_2-(OCH_2-CHR)_n-OH$ (VII) $C_mH_{(2m+1)}-CH(OCH_2-CHR)_n-OH)-CH_2OH$ (VIII) $C_mH_{(2m+1)}-CH(OCH_2-CHR)_n-OH)-CH_2-(OCH_2-CHR)_n-OH$ (IX) $C_mH_{(2m+1)}-CHOH-CH_2OSO_3Me$ (X) $C_mH_{(2m+1)}-CH(OSO_3Me)-CH_2OH$ (XI) $C_mH_{(2m+1)}-CH(OSO_3Me)-CH_2-OSO_3Me$ (XII) $C_mH_{(2m+1)}-CH(OSO_3Me)-CH_2-(OCH_2-CHR)_n-OSO_3Me$ (XIII) $C_mH_{(2m+1)}-CH(OCH_2-CHR)_n-OSO_3Me)-CH_2OSO_3Me$ (XIV) $C_mH_{(2m+1)}-CH(OCH_2-CHR)_n-OSO_3Me)-CH_2-(OCH_2-CHR)_n-OSO_3Me$

Preferred are those compounds of formula (I) wherein the average number $n$ of the alkylene oxide groups is 1, and wherein the integer m ranges from 13 to 16.

In the production of the surfactants of component (B) the starting material is 1,2-epoxyalkanes of 10 to 22 carbon atoms or 1,2-alkanediols of 10 to 22 carbon atoms. The epoxides are reacted with an excess of ethylene glycol and/or propylene glycol, the excess being subsequently removed again. The 1,2-alkanediols are reacted in a molar ratio of 1:1 to 1:5 preferably 1:1 to 1:2, with ethylene oxide and/or propylene oxide. The ether alcohols obtained, which can contain unreacted starting material, are subsequently sulfated in known manner. Suitable sulfation agents are sulfuric acid, oleum, chlorosulfonic acid, and surfur trioxide, which can be dissolved in gas form, diluted with inert gases or dissolved in solvents, such as dichlorethane, carbon tetrachloride, dioxane or liquid sulfur dioxide. So much of the sulfation agent is used that after the sulfation reaction, the sulfation product contains from 0.7 to 1.1 mols of sulfuric acid ester groups per one mole of ether alcohol. Small amounts of the initial products, that is unalkoxylated and unsulfated diols, can also be present. The neutralization of the sulfuric acid ester can be effected in known manner with alkali metal hydroxides such as sodium hydroxide or with alkali metal carbonates (or both) of sodium, potassium or ammonium or with organic ammonium bases.

Suitable examples of component (B) include monoalkylene glycol ether sulfates or polyalkylene glycol ether sulfates of higher 1,2-alkanediols which are derived from 1,2-alkanediols of 10 to 20 carbon atoms, preferably 15 to 18 carbon atoms. The glycol ethers are obtained by hydrolysis of the corresponding long-chained, terminal epoxidized olefins to the corresponding 1,2-alkanediols and then reaction of these diols with 1 to 5 moles of alkylene oxide, preferably 1 to 2 moles of alkylene oxide. The glycol ethers are also obtained by direct reaction of the epoxidized olefins with one mole of a polyalkylene glycol having 1 to 5 alkoxy groups, preferably 1 to 2 alkoxy groups.

The reaction is also effected in known manner with alkylene oxides, such as ethylene oxide and/or propylene oxide in the presence of acid or alkaline catalysts, preferably under pressure and at elevated temperatures. The alkoxylation products are generally used as starting materials for the subsequent sulfation without further purification.

The sulfation of the adducts is effected in known manner by reaction with strong sulfating agents, such as those discussed above in the same ratio. Suitable examples of sulfation products include the sulfation products containing about one $-SO_3Me$ groups per mol of the adducts of 1 to 5 moles, preferably 1 to 2 moles, of ethylene oxide on 1,2-alkanediols of 10 to 20 carbon atoms, preferably 15 to 18 carbon atoms, or the sulfation products of the adducts of 1 to 5 moles, preferably 1 to 2 moles, of propylene oxide on 1,2-alkanediols of 10 to 20 carbon atoms, preferably 15 to 18 carbon atoms. All of these products are preferably present in the form of their sodium or potassium salts. The weight ratio of the components (A) to (B) is from 20:80 to 90:10. Preferred is a mixture in which component (A) is predominate in the ratio of (A) to (B), particularly a ratio of (A) to (B) which ranges from 70:30 to 90:10.

The compositions are preferably used in the form of aqueous concentrates or aqueous alcoholic concentrates containing from 10% to 60% by weight, preferably from 20% to 45% by weight based upon the total weight of components (A) and (B). The concentrates can contain from 0% to 10% by weight of other customary dishwashing concentrate ingredients such as preservatives and disinfectants, and if desired perfume oils, dyes, skin protectors, solution aids or opacifiers. The balance of the concentrate composition to 100% by weight is made up of an aqueous liquid such as water or an aqueous solution of water-miscible lower alkanols.

The surfactant concentrates are preferably used for manual dishwashing. They are added to the cleansing bath in amounts of about 0.01 to 10 gm/liter preferably 0.5 to 2 gm/liter, based upon the concentrate. The compositions of the invention have a synergistic cleansing effect when compared to the individual anionic surfactants of component (A) or when compared to the mixtures of these anionic surfactants of component (A).

With the same amount of active substance, the number of cleansed and washed dishes in a specific volume of wash liquor is considerably increased.

The combinations of the invention can also be used for other cleansing jobs, for example, for cleansing tiles, table tops, metal coverings, etc. They can therefore be used around the house for many other types of cleansing apart from dishwashing.

EXAMPLES

The following examples are merely illustrative of the present invention without being deemed limitative in any manner thereof.

A few compositions are given below which have proved especially good in practice. The invention is not restricted to the following mixtures, however, and these can be varied in many ways or be supplemented by the additional washing agent substances mentioned in the description. The sulfate and sulfonate basic surface-active washing components are generally used as the sodium salts although other alkali metal salts may be employed. If liquid preparations are used, the anionic detergent substances may advantageously be used in the form of the mono-, di- or tri- ethanolammonium salts.

Liquid dishwashing and cleansing agents may contain from 30% to 90% by weight of aqueous liquid solvents such as water or aqueous solutions of watermiscible organic solvents from the class of $C_2$ to $C_3$ alcohols for example lower alkanols having 2 to 3 carbon atoms such as ethanol, propanol or isopropanol, and the ether alcohols of the $C_2$ to $C_3$ alcohols.

The cleansing results compiled in the following Table were determined with the "Mechanized Dish Test With Photometric End Point Determination" (See Fette, Seifen, Anstrichmittel, Vol. 74, 163–165 (1972 No. 3)). For comparison, a dishwashing combination of 80% dodecyl benzene sulfonate and 20% of the sulfate of a fatty alcohol mixture of 12 to 14 carbon atoms with 2 moles of ethylene oxide adducted thereon, was used. This corresponds in its composition to known commercial dishwashing detergents.

In the following table:

EO = moles ethylene oxide

PrO = moles propylene oxide

| Examples | Components | Concentration gm/liter | Number of Dishes cleansed |
|---|---|---|---|
| 1 | 80% Na-dodecyl benzene sulfonate<br>20% Na-($C_{16}$-1,2-alkanediol + 1 PrO) monosulfate | 0.15 | 20.5 |
| 2 | 80% Na-dodecyl benzene sulfonate<br>20% Na-($C_{16}$-1,2-alkanediol + 3 EO) monosulfate | 0.15 | 19 |
| 3 | 80% Na-dodecyl benzene sulfonate<br>20% Na-($C_{15}$ to $C_{18}$-1,2-alkanediol + 1 PrO) monosulfate | 0.15 | 21.9 |
| 4 | 80% Na-dodecyl benzene sulfonate<br>20% Na-($C_{16}$-1,2-alkanediol + 1 EO) monosulfate | 0.15 | 20.9 |
| Comparison | 80% Na-dodecyl benzene sulfonate<br>20% Na-fatty alcohol-$C_{12}$ to $C_{14}$-2 EO-sulfate | 0.15 | 18 |

EXAMPLE 5

A liquid dish washing agent concentrate had a content of 60% by weight of the following composition:

16% by weight Na—salt of $C_{18}$ — olefin sulfonate,

4% by weight Na— ($C_{16}$—1,2-alkanediol + 3 EO) monosulfate,

5% by weight urea, 0.1% by weight Na-benzoate, (0.1% by weight perfume oil if desired and about 0.002% by weight dyes if desired)

the balance up to 100% by weight of water.

EXAMPLE 6

Another liquid dishwashing agent concentrate had a content of 45% per weight of the following composition:

16% by weight Na-dodecysulfate,

2% by weight Na-dodecylbenzene sulfonate,

2% by weight Na—($C_{15}$—to $C_{18}$—1,2—alkanediol + 1 PrO)monosulfate, 0.2% by weight EDTA, and the balance up to 100% by weight of water.

Although the present invention has been disclosed in connection with a few preferred embodiments thereof, variations and modifications may be resorted to by those skilled in the art without departing from the principles of thee new invention. All of these variations and modifications are considered to be within the spirit and scope of the present invention as disclosed in the foregoing description and defined by the appended claims.

We claim:

1. Anionic surface active composition for manually washing and cleansing dishes consisting essentially of (A) from 20% to 90% by weight of a first component selected from the group consisting of alkyl sulfonates having 8 to 20 carbon atoms, olefin sulfonates having 8 to 20 carbon atoms, α-sulfofatty acid alkyl esters having 8 to 20 carbon atoms in the α-sulfofatty acid and 1 to 4 carbon atoms in the alkyl, dialkyl sulfosuccinic acid esters having 8 to 20 carbon atoms in the alkyls, alkylbenzene sulfonates having 8 to 20 carbon atoms in the alkyl, alkyl sulfates having 8 to 20 carbon atoms and the mixtures thereof and (B) from 10% to 80% by weight of a second component selected from the group consisting of a monoglycol ether monsulfate of a 1,2-alkanediol having 10 to 22 carbon atoms and a polyglycol ether monosulfate of a 1,2-alkanediol having 10 to 22 carbon atoms, said sulfation product containing per mol of ether diol from 0.7 to 1.1 moles of sulfuric acid ester and said sulfation product being an adduct of no more than 5 mols of an alkylene oxide having 2 to 3 carbon atoms on said diol said components (A) and (B) being present in the form of their salts selected from the group consisting of alkali metal salts, ammonium salts, lower alkanolamine salts, lower alkylamine salts, and the mixtures thereof.

2. The composition of claim 1, wherein said second component (B) is selected from the group consisting of a monoglycol ether monosulfate of a 1,2-alkanediol having 10 to 20 carbon atoms and a polyglycol ether monosulfate of a 1,2-alkanediol having 10 to 20 carbon atoms.

3. The composition of claim 1, wherein said first component (A) is selected from the group consisting of olefin sulfonates having 10 to 20 carbon atoms and alkylbenzene sulfonates having 10 to 14 carbon atoms in the alkyl.

4. The composition of claim 1, wherein said second component (B) is the sulfation product containing about one sulfate group per mol of an adduct of 1 to 2 mols of an alkylene oxide having 2 to 3 carbon atoms on a 1,2-alkanediol having 15 to 18 carbon atoms.

5. The composition of claim 1, wherein the weight ratio of component (A) to component (B) is from 70:30 to 90:10.

6. A dishwashing and cleansing agent concentrate for dishwashing based upon anionic surface active surfactants consisting essentially of (I) from 10% to 60% by weight of an anionic surface active surfactant mixture consisting essentially of (A) from 20% to 90% by weight of a first component selected from the group consisting of alkyl sulfonates having 8 to 20 carbon atoms, olefin sulfonates having 8 to 20 carbon atoms, $\alpha$-sulfofatty acid alkyl esters having 8 to 20 carbon atoms in the $\alpha$-sulfofatty acid and 1 to 4 carbon atoms in the alkyl, dialkyl sulfosuccinic acid esters having 8 to 20 carbon atoms in the alkyls, alkylbenzene sulfonates having 8 to 20 carbon atoms in the alkyl, alkyl sulfates having 8 to 20 carbon atoms and the mixtures thereof and (B) from 10% to 80% by weight of a second component selected from the group consisting of a monoglycol ether monosulfate of a 1,2-alkanediol having 10 to 22 carbon atoms and a polyglycol ether monosulfate of a 1,2-alkanediol having 10 to 22 carbon atoms said sulfation product containing per mol of ether diol from 0.7 to 1.1 moles of sulfuric acid ester and said sulfation product being an adduct of no more than 5 mols of an alkylene oxide having 2 to 3 carbon atoms on said diol, said components (A) and (B) being present in the form of their salts selected from the group consisting of alkali metal salts, ammonium salts, lower alkanolamine salts, lower alkylamine salts, and the mixtures thereof; (II) from 0% to 10% by weight of a preservative, a disinfectant, a perfume oil, a dye, a skin protector, a solution aid, an opacifier or mixtures thereof; and (III) the remainder to 100% by weight of an aqueous liquid selected from the group consisting of water and aqueous solution of a water-miscible lower alkanol.

7. The concentrate of claim 6, wherein said second component (B) is selected from the group consisting of a monoglycol ether monosulfate of a 1,2-alkanediol having 10 to 20 carbon atoms and a polyglycol ether monosulfate of a 1,2-alkanediol having 10 to 20 carbon atoms.

8. In the process for the manual washing of dishes which comprises subjecting dirty dishes to the action of a washing solution, subjecting the washed dishes to at least one rinsing solution and recovering said washed dishes, the improvement consisting of utilizing an aqueous solution containing from 0.01 to 10 gm/liter of an anionic surface active composition for washing and cleansing dishes consisting essentially of (A) from 20% to 90% by weight of a first component selected from the group consisting of alkyl sulfonates having 8 to 20 carbon atoms, olefin sulfonates having 8 to 20 carbon atoms, $\alpha$-sulfofatty acid alkyl esters having 8 to 20 carbon atoms in the $\alpha$-sulfofatty acid and 1 to 4 carbon atoms in the alkyl, dialkyl sulfosuccinic acid esters having 8 to 20 carbon atoms in the alkyls, alkylbenzene sulfonates having 8 to 20 carbon atoms in the alkyl, alkyl sulfates having 8 to 20 carbon atoms and the mixtures thereof and (B) from 10% to 80% by weight of a second component selected from the group consisting of a monoglycol ether monosulfate of a 1,2-alkanediol having 10 to 22 carbon atoms and a polyglycol ether monosulfate of a 1,2 -alkanediol having 10 to 22 carbon atoms said sulfation product containing per mol of ether diol from 0.7 to 1.1 moles of sulfuric acid ester and said sulfation product being an adduct of no more than 5 mols of an alkylene oxide having 2 to 3 carbon atoms on said diol, said components (A) and (B) being present in the form of their salts selected from the group consisting of alkali metal salts, ammonium salts, lower alkanolamine salts, lower alkylamine salts and the mixtures thereof, as said washing solution.

9. The process of claim 8, in which said aqueous solution contains from 0.5 to 2 gm/liter of said anionic surface active composition.

* * * * *